US005423545A

United States Patent [19]

Narry

[11] Patent Number: 5,423,545

[45] Date of Patent: Jun. 13, 1995

[54] GOLF PUTTER WITH IMPROVED SIGHTING CAPABILITIES

[76] Inventor: Brian C. Narry, 165 Red Dog Rd., Georgetown, Pa. 15043

[21] Appl. No.: 181,006

[22] Filed: Jan. 14, 1994

[51] Int. Cl.[6] ..... A63B 53/04

[52] U.S. Cl. ..... 273/167 R; 273/163 R; 273/80.2; 273/80 C; 273/167 H

[58] Field of Search ..... 273/163 R, 164.1, 80.1, 273/80.2, 80.4, 80.5, 167 R, 172, 167 D, 167 F, 170, 187.5, 187.6; D22/214, 217, 219

[56] References Cited

U.S. PATENT DOCUMENTS

| | | | |
|---|---|---|---|
| 3,387,845 | 6/1968 | Raub | 273/164.1 |
| 3,880,430 | 4/1975 | McCabe | 273/164.1 |
| 4,136,877 | 1/1979 | Antonious | 273/164.1 |
| 4,141,556 | 2/1979 | Paulin | 273/164.1 |
| 4,844,468 | 7/1989 | Lee | 273/163 R |

*Primary Examiner*—Vincent Millin
*Assistant Examiner*—William M. Pierce

[57] ABSTRACT

A new and improved golf putter with improved sighting capabilities comprising, a front striking face of a generally planar configuration positioned at rearwardly from the vertical and with a toe face and a heel face extending rearwardly from the front striking face in a generally vertical orientation, and with a curved sole plate and a planar top plate extending rearwardly in a generally horizontal orientation from the front face, the rearwardly extending faces and plates forming a peripheral cavity back peripherally behind the front face with the sole plate extending rearwardly a greater distance than the top plate, a rectangular block centrally secured to the upper surface of the top plate and with an angled upper surface having a hole constituting a hosel, a shaft having an upper end with a handle and having a lower end positioned within the hosel; and a plurality of sighting lines, the sighting lines including a pair of parallel lines perpendicular to the face symmetrically disposed horizontally on the top plate on opposite sides of the block, the sighting lines also including a pair of parallel lines extending symmetrically disposed vertically on the rear of the sole plate centrally located with respect to the face at a distance equal to the diameter of a golf ball.

2 Claims, 2 Drawing Sheets

GOLF PUTTER WITH IMPROVED SIGHTING CAPABILITIES

BACKGROUND OF THE INVENTION

1. Field of the Invention

The present invention relates to golf putters with improved sighting capabilities and more particularly pertains to a putter with plural sighting lines at plural levels to improve putting.

2. Description of the Prior Art

The use of golf putters with sighting capabilities is known in the prior art. More specifically, golf putters with sighting capabilities heretofore devised and utilized for the purpose of aligning putts are known to consist basically of familiar, expected, and obvious structural configurations, notwithstanding the myriad of designs encompassed by the crowded prior art which has been developed for the fulfillment of countless objectives and requirements.

The prior art discloses various types of putters including head with sighting devices. By way of example, U.S. Pat. No. 4,902,014 to Bontomase discloses a putter with a sighting device centrally disposed on the top of the head.

U.S. Pat. Nos. 4,962,927 to Colucci and 5,072,941 to Klein disclose putters with centrally disposed sighting lines.

Lastly, U.S. Pat. Nos. Des. 303,276 to Oakleaf and Des. 331,611 to Gibheart disclose ornamental designs for golf putter heads.

The prior art discloses various types of putters including head with sighting devices. By way of example, U.S. Pat. No. 4,902,014 to Bontomase discloses a putter with a sighting device centrally disposed on the top of the head.

U.S. Pat. Nos. 4,962,927 to Colucci and 5,072,941 to Klein disclose putters with centrally disposed sighting lines.

Lastly, U.S. Pat. Nos. Des. 303,276 to Oakleaf and Des. 331,611 to Gibheart disclose ornamental designs for golf putter heads.

In this respect, the golf putter with improved sighting capabilities according to the present invention substantially departs from the conventional concepts and designs of the prior art, and in doing so provides an apparatus primarily developed for the purpose of providing a golf putter with improved sighting capabilities.

Therefore, it can be appreciated that there exists a continuing need for a new and improved golf putter with improved sighting capabilities which can be used for improving putting. In this regard, the present invention substantially fulfills this need.

SUMMARY OF THE INVENTION

In view of the foregoing disadvantages inherent in the known types of putters with alignment capabilities now present in the prior art, the present invention provides an improved golf putter with improved sighting capabilities. As such, the general purpose of the present invention, which will be described subsequently in greater detail, is to provide a new and improved golf putter with improved sighting capabilities.

To attain this, the present invention essentially comprises a new and improved golf putter with enhanced sighting capabilities comprising, a front striking face in a generally planar configuration positioned at about four degrees rearwardly from the vertical and with a toe face and a heel face extending rearwardly from the front striking face in a generally vertical orientation, and with a curved sole plate and a planar top plate extending rearwardly in a generally horizontal orientation from the front face, the rearwardly extending faces and plates forming a cavity back peripherally behind the front face with the sole plate extending rearwardly a greater distance than the top plate, a rectangular block secured centrally to the upper surface of the top plate and with an angled upper surface having a hole constituting a hosel, a tubular shaft having an upper end provided with a handle and having a lower end positioned within the hosel, a plurality of sighting lines, the sighting lines including a pair of parallel lines perpendicular to the face symmetrically disposed horizontally on the top plate on opposite sides of the block, the sighting lines also including a pair of parallel lines extending symmetrically disposed vertically on the rear of the sole plate centrally located with respect to the face at a distant equal to the diameter of a golf ball, the sighting lines also including a single line perpendicular to the face disposed horizontally on the top plate forward of the center of the block; and a sighting disk formed of a lower cap removably positionable over the upper extent of the shaft and an upper extent including a ring positionable in a vertical plane with cross hairs in a horizontal and vertical orientation crossing at the midpoint at the ring.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved golf putters with improved sighting capabilities.

It is another object of the present invention to provide new and improved golf putter with improved sighting capabilities which may be easily and efficiently manufactured and marketed.

It is further object of the present invention to provide a new and improved golf putter with improved sighting capabilities which are of durable and reliable constructions.

An even further object of the present invention is to provide a new and improved golf putter with improved sighting capabilities which are susceptible of a low cost of manufacture with regard to both materials and labor, and which accordingly are then susceptible of low prices of sale to the consuming public, thereby making such golf putter with improved sighting capabilities economically available to the buying public.

Even still another object of the present invention is to align putts more accurately and more consistently.

Lastly, it is an object of the present invention to provide a new and improved golf putter with improved sighting capabilities comprising, a front striking face of a generally planar configuration positioned at rearwardly from the vertical and with a toe face and a heel face extending rearwardly from the front striking face in a generally vertical orientation, and with a curved sole plate and a planar top plate extending rearwardly in a generally horizontal orientation from the front face, the rearwardly extending faces and plates forming a peripheral cavity back peripherally behind the front face with the sole plate extending rearwardly a greater distance than the top plate, a rectangular block centrally secured to the upper surface of the top plate and with an angled upper surface having a hole constituting a hosel, a shaft having an upper end with a handle and having a lower end positioned within the hosel; and a plurality of sighting lines, the sighting lines including a pair of parallel lines perpendicular to the face symmetrically disposed horizontally on the top plate on opposite sides of the block, the sighting lines also including a pair of parallel lines extending symmetrically disposed vertically on the rear of the sole plate centrally located with respect to the face at a distant equal to the diameter of a golf ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
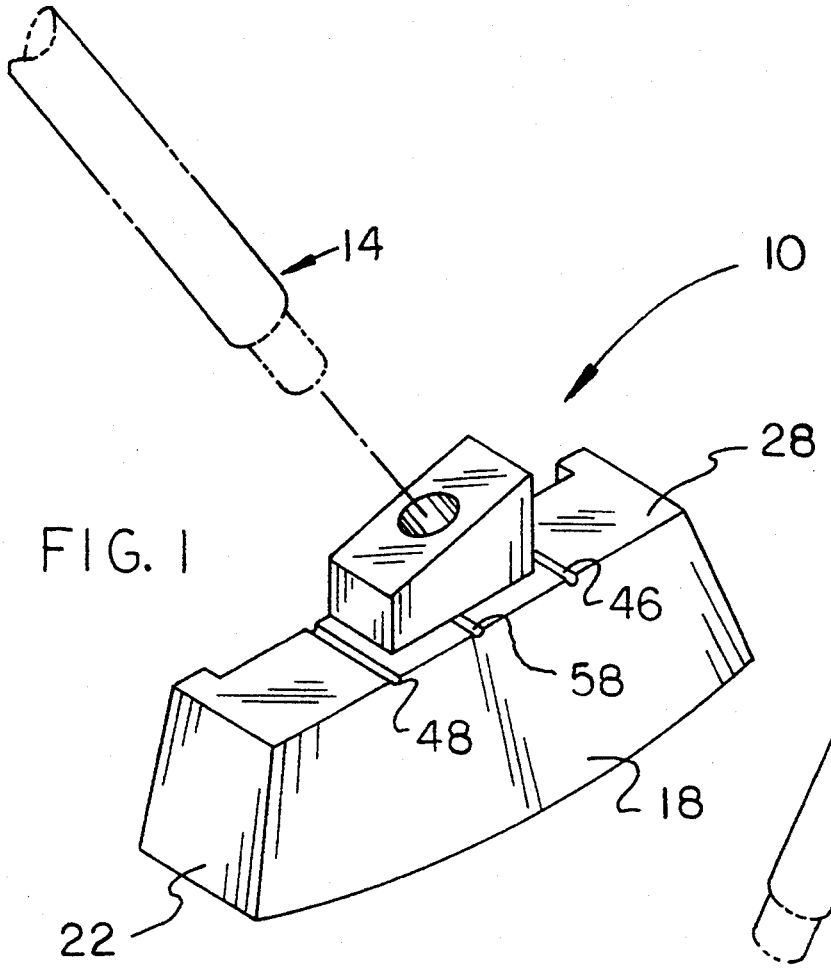
FIG. 1 is a perspective view of the front of the golf putter head constructed in accordance with the principles of the present invention.
Figure 2:
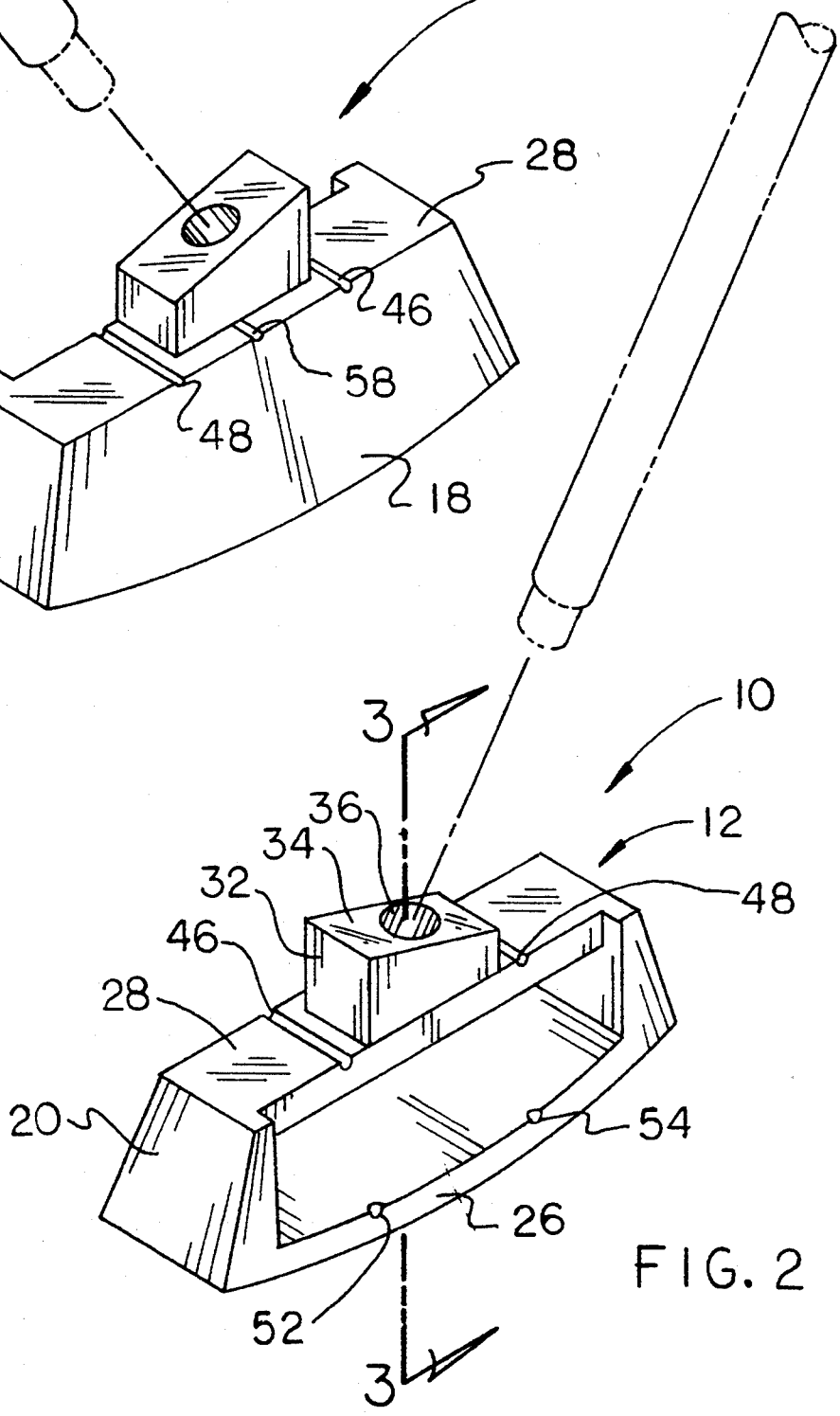
FIG. 2 is a rear perspective view of the head shown in FIG. 1.
Figure 3:
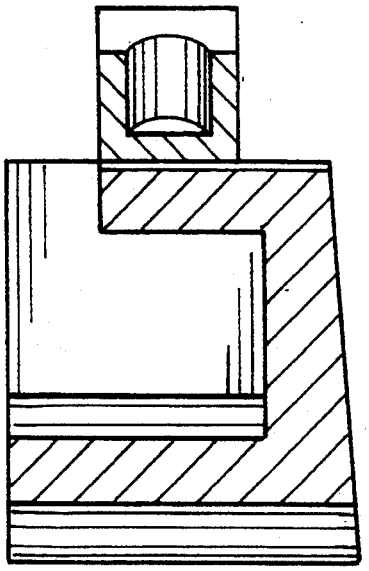
FIG. 3 is a sectional view of the head of the prior Figures taken along line 3—3 of FIG. 2.
Figure 4:
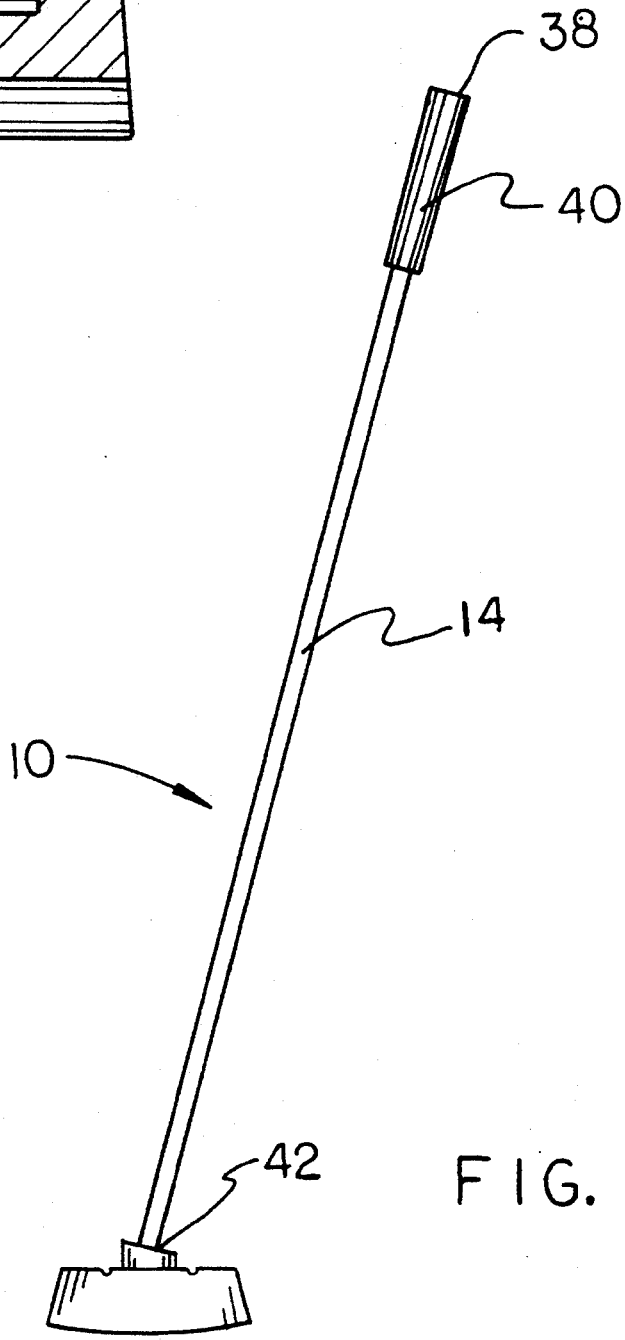
FIG. 4 is a plan view of the golf club including a shaft and head as illustrated in the prior Figures.

With reference now to the drawings, and in particular to FIG. 1 thereof, the preferred embodiment of the new and improved golf putter with improved sighting capabilities embodying the principles and concepts of the present invention and generally designated by the reference numeral 10 will be described.

More specifically, it will be noted in the various Figures, particularly FIGS. 1 through 4, that there is disclosed a new and improved golf putter 10. Such putter 10 is provided with improved sighting capabilities. The principal aspect is a plurality of sighting lines.

In the preferred embodiment, the putter includes a head 12 and shaft 14. The head 12 has a front striking face 18. The face is of a generally planar configuration. The front striking face is positioned at about four degrees rearwardly from vertical. The head also has a toe face 20 and a heel face 22. Each such face extends rearwardly from the front face 18 in a generally vertical orientation.

Formed with the lower edge of the front face is a curved sole plate 26 and a planar top plate 28. Each such plate extends rearwardly in a generally horizontal orientation from the upper edge of the front face 18. Each plate is terminated at a free edge remote from the front striking surface. The rearwardly extending faces and plates form a cavity back behind the front face. In order to accommodate the desired sighting lines the sole plate 26 extends rearwardly from the front striking face a greater distance than the top plate 28.

Centrally secured to the upper surface of the top plate 28 is a rectangular block 32. Such block has an angled upper surface 34. A hole constituting a hosel 36 is located in such upper surface for receiving the shaft 14.

The shaft has an upper end 38 with a handle 40. The shaft also has a lower end 42 positioned within the hosel 36. The shaft extends upwardly at an angle from the head 12 as is conventional.

Extended accuracy is provided to the putter 10 due principally to the use of a plurality of uniquely oriented sighting lines. The sighting lines include a pair of parallel lines 46 and 48 extending perpendicular to the front striking face 18. Such lines are symmetrically disposed horizontally on the top plate on opposite sides of the block 32. Two additional sighting lines 52 and 54 extending vertically on the free edge of the sole plate 26. Such additional sighting lines are centrally located with respect to the face and vertically oriented. They are spaced a distant equal to the diameter of a golf ball. A final sighting line 58 extends perpendicular to the front striking face 18. Such line is disposed horizontally on the top plate forward of the block 34.

The golf putter with improved sighting capabilities is a next-generation putter that will enable golfers to putt with significantly more accuracy than before. Numerous design enhancements have been added in order to achieve this improved performance.

The first of these enhancements has to do with the design of the back of the putter. Here we find a cavity back design, which helps to achieve a total perimeter weighing. In layman terms, the result is a sweet spot covering a much larger area than normal. This allows the user a greater margin of error in striking the ball.

The golf putter with improved sighting capabilities also features clearly visible double sight lines on both the top line area and the bottom flange of the cavity back. These sight lines are paint-filled grooves, and the distance between the two outside sight lines is exactly the diameter of a golf ball, which aids the golfer in lining up the putt. Also, the two sets of sight lines enable the golfer to make sure his/her eyes are in the correct position, directly over the line of the putt.

Golfers are always looking for ways of improving their game, and the golf putter with improved sighting capabilities certainly qualifies as a means to that end. As putting is a very large part of the golf game, the importance of a putter cannot be understated. It is obvious that a lot of care has gone into the design of this product. It is superior in many ways to similar products already on the market, which certainly bodes well for its future.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials shape form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf putter comprising, in combination:

a front striking face in a generally planar configuration positioned at about four degrees rearwardly from vertical and with a tow face and a heel face extending rearwardly from the front striking face in a generally vertical orientation, and with a curved sole plate and a planar top plate each extending rearwardly in a generally horizontal orientation from the front striking face and each terminated at a free edge remote from the striking surface, the rearwardly extending faces and plates forming a cavity back peripherally behind the front striking face with the sole plate extending rearwardly a greater distance than the top plate;

a rectangular block secured centrally on the top plate and with an angled upper surface having a hole constituting a hosel;

a tubular shaft having an upper end provided with a handle and a lower end positioned within the hosel; and a plurality of lines, the lines including a pair of parallel lines perpendicular to the front striking face and symmetrically disposed horizontally on the top plate on opposite sides of the block, the lines also including a pair of parallel lines extending symmetrically and disposed vertically on the free edge of the sole plate and centrally located with respect to the front striking face at a distance equal to the diameter of a golf ball, the lines also including a single line perpendicular to the front striking face disposed horizontally on the top plate forward of the center of the block.

2. A golf putter comprising:

a front striking face in a generally planar configuration positioned at about four degrees rearwardly from vertical and with a tow face and a heel face extending rearwardly from the front striking face in a generally vertical orientation, and with a curved sole plate and a planar top plate each extending rearwardly in a generally horizontal orientation from the front striking face and each terminated at a free edge remote from the striking surface, the rearwardly extending faces and plates forming a cavity back peripherally behind the front striking face with the sole plate extending rearwardly a greater distance than the top plate;

a rectangular block secured centrally on the top plate and with an angled upper surface having a hole constituting a hosel; and a tubular shaft having an upper end provided with a handle and a lower end positioned within the hosel.

* * * * *